US005099533A

United States Patent [19]

Bland

[11] Patent Number: 5,099,533

[45] Date of Patent: Mar. 31, 1992

[54] PARTIAL PILLOW COVER

[76] Inventor: Michelle Bland, 4515 John Tyler Ct., Apt. 302, Annandale, Va. 22003

[21] Appl. No.: 726,351

[22] Filed: Jul. 5, 1991

[51] Int. Cl.[5] ..... A47G 9/04

[52] U.S. Cl. ..... 5/490; 5/923

[58] Field of Search ..... 5/490, 496, 498, 491, 5/482; 297/219; 24/72.5

[56] References Cited

U.S. PATENT DOCUMENTS 2,516,363 7/1950 Block et al. ..... 297/219
3,423,774 1/1969 Streetman ..... 5/490
4,627,363 12/1986 Jones ..... 108/90
4,891,856 1/1990 Thornhill ..... 5/496

*Primary Examiner*—Alexander Grosz

[57] ABSTRACT

A partial pillow cover comprising a rectangular sheet of smooth surface fabric having means for attaching the sheet to one surface of a pillow, said attaching means comprising at least (4) straps secured to all four corners of said sheet, straps at opposite corners forming a first and second pair and straps of each pair being in linear alignment with each other, free ends of the straps remote from the corners having hook and loop type fasteners affixed thereto for attachment to each other.

4 Claims, 1 Drawing Sheet

PARTIAL PILLOW COVER

BACKGROUND OF THE INVENTION

Made of soft smooth Satin fabric. For the convenience of sustaining hairs' shape, style and body with little fuss.

FIELD OF THE INVENTION

Removable Partial Pillow Covering

The invention relates to the means of maintaining set hairstyles/hairdos while sleeping/resting. Allowing the user to sleep comfortably on a soft smooth Satin pillow cover without causing friction to the hair, and without using a hair covering of any sort.

SUMMARY OF THE INVENTION

One of the advantages of the invention is that it will save the user time, by not having to reset newly styled hair. Partial pillow cover is easily removable from one pillow to another. It comes conveniently in a small carrying case so that a person frequently traveling can still use it away from home. The invention is designed to preserve the style, body and shape of the hair. It is made of a soft smooth Satin pillow fabric. The invention can easily be washed on a gentle and delicate cycle, and can be laid out on a flat surface to dry, or put into a dryer on a gentle cycle to be dried. The invention will eliminate friction to the user's hair that can exist by using other fabric pillow coverings.

Figure 1:
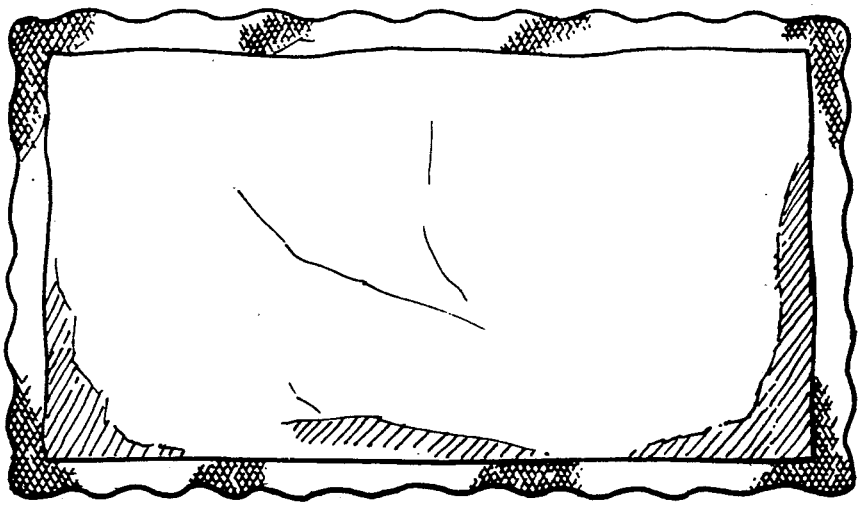
FIG. 1 is a front view of a covered pillow.
Figure 2:
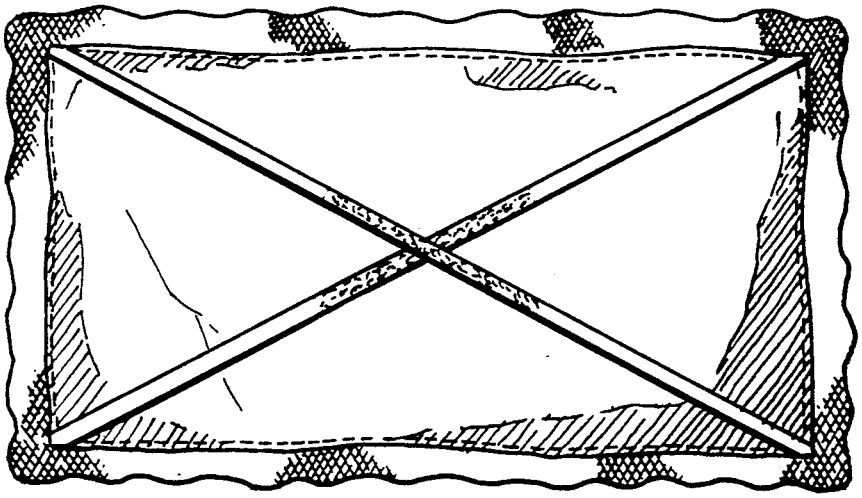
FIG. 2 is a rear view of a covered pillow.
Figure 3:
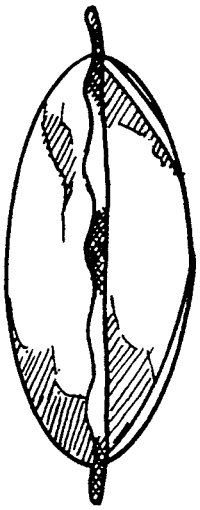
FIG. 3 is a side view of a covered pillow.

1. Fabric cut in a rectangular shape to fit size of pillow. With adorned lace added around all four sides of fabric for added touch and appearance. FIG. One 2. Back of partial pillow cover shows stitching. FIG. Two—The invention has four straps sewn on its backing. From each corner straps One and Two, and straps Three and Four overlap each other with VELCRO-hook and loop type fasteners mating with each other (commonly known as VELCRO). Hook and Loop type fasteners are one third (⅓) the size of the actual strap to support the pillow to keep it in a stationary position for the user.

DETAILED DESCRIPTION OF THE DRAWINGS (INVENTION)

FIG. Three—The invented partial pillow cover will come in three sizes: Standard, Queen or King to accommodate any pillow size. It is made from a soft smooth Satin fabric. It is rectangular in shape—further including four straps approximately one inch (1") in width placed at the rear surface at all four corners. The straps are diagonally from each other to secure the pillow in place once it is inserted onto the partial pillow cover. Straps One and Two will overlap, then straps Three and Four will overlap, locking and securing the pillow in its set position. Each of the straps are sufficient in length to overlap each other. Hook and loop type fasteners are sewn at the free ends of the straps—mating with each other in opposite corners. Hook and loop type fasteners are one third (⅓) the length of the straps. Turning the pillow over to the front surface is a soft smooth satin pillow covering to add ease and comfort to the user while sleeping or resting.

What is claimed is:

1. A partial pillow cover comprising a rectangular sheet of smooth surface fabric having means for attaching the sheet to one surface of a pillow, said attaching means comprising at least (4) straps secured to all four corners of said sheet, straps at opposite corners forming a first and second pair and straps of each pair being in linear alignment with each other, free ends of the straps remote from the corners having hook and loop type fasteners affixed thereto for attachment to each other.

2. The pillow cover of claim 1, wherein the smooth surface fabric is a satin material.

3. The pillow cover of claim 1, wherein a strip of decorative material is attached around the peripheral edges of the rectangular sheet.

4. The pillow cover of claim 1, wherein the lengths of the hook and loop type fasteners comprises one third of the lengths of the straps, whereby said cover may be adjusted to different size pillows.

* * * * *